US005454567A

United States Patent [19]

Adell

[11] Patent Number: 5,454,567

[45] Date of Patent: Oct. 3, 1995

[54] COMBINED CARD AND KEY CARRYING CASE AND LOTTERY NUMBER PICKER

[76] Inventor: Robert Adell, 31800 S. Brandingham, Franklin, Mich. 48025

[21] Appl. No.: 394,769

[22] Filed: Feb. 27, 1995

[51] Int. Cl.[6] ..... A63F 3/06

[52] U.S. Cl. ..... 273/144 B; 150/147; D3/208; 273/148 R

[58] Field of Search ..... 273/144 B, 144 R, 273/145 C, 145 CA, 144 A, 269; 150/147; D3/207, 208, 210

[56] References Cited

U.S. PATENT DOCUMENTS

| | | | |
|---|---|---|---|
| 4,403,775 | 9/1983 | Chaput | 273/144 B |
| 4,807,881 | 2/1989 | Jaquez | 273/144 B |
| 5,358,245 | 10/1994 | Adell | 273/144 B |

FOREIGN PATENT DOCUMENTS

| | | | |
|---|---|---|---|
| 2245840 | 1/1992 | United Kingdom | 273/269 |

*Primary Examiner*—Benjamin H. Layno
*Attorney, Agent, or Firm*—Alex Rhodes

[57] ABSTRACT

A case for cards, keys and numbered disks and for randomly picking lottery numbers. The case is comprised of a platform having a first space for storing a card and disks and a second space for storing a card; a plurality of thin numbered disks stored in the first space; a transparent cover attached to a top and a bottom of the platform for viewing and enclosing the card and disks in the spaces and a chain attached to end portions of the covers for carrying keys. One characterizing feature of the invention is a trap which permits the numbered disks to easily enter but impedes disks inside the trap from leaving the trap. Another characterizing feature is that cards can be placed in the case without disassembly of the case.

15 Claims, 5 Drawing Sheets

COMBINED CARD AND KEY CARRYING CASE AND LOTTERY NUMBER PICKER

FIELD OF THE INVENTION

This invention relates to cases and games of chance and more particularly to a case for carrying cards and keys and numbered disks and for randomly picking lottery numbers.

BACKGROUND OF THE INVENTION

Government lotteries are major sources of revenues in the United States and foreign countries. Each year, billions of dollars are collected from lotteries in the United States and foreign countries. Annual lottery collections in the U.S.A. has equalled the combined income of America's five most profitable corporations.

Lotteries have such popular acceptance with Americans that it is believed that the federal government may soon adopt a national lottery as a measure for trimming its large budget deficits. National lotteries already exist in numerous countries, including Canada, Great Britain, France, Germany, Spain, Switzerland, Australia, Ireland and Austria.

Lottery betting stations are most often located in retail establishments such as supermarkets, pharmacies and party stores. Many betters delay the selections of numbers until arriving at betting stations, sometimes causing lines of betters. A compact, transportable lottery number picker would be of great value because it would allow players to quickly generate lottery numbers at betting stations. Provisions for carrying cards and keys would enhance the utility of the device.

Cards could be used for identifying owners of lost keys, for recording information such as vehicle license numbers which are needed when purchasing fuel and checking in at hotels, and for advertising services of businesses and professionals. The utility of the case would be further enhanced if cards could be easily installed with disassembling the case. This would provide purchasers with an option of choosing a card which meets their needs. Moreover, it would allow manufacturers export the same cases, less cards, which are marketed in the United States.

SUMMARY OF THE INVENTION

The present invention is a compact, transportable case for carrying cards, keys and numbered disks and for randomly picking lottery numbers. One advantage of the invention is that it can be used at betting stations for picking lottery numbers. This would reduce congestion at betting stations, particularly when prizes are large. The reduced congestion would reduce waiting time for placing bets and the interference with a proprietor's usual business. A further benefit is that the case can also be used as an identification tag for suitcases and brief cases.

The case is comprised of a platform having a space for disks and a space for storing a card; a plurality of thin numbered disks stored in the first space; a transparent cover attached to a top of the platform for viewing and covering the disks, a transparent cover attached to the bottom of the platform for covering and viewing the card, and a chain attached to the covers for carrying keys.

A characterizing feature of the invention is a trap which allows numbered disks to easily enter but impedes disks inside the trap from easily leaving the trap. Another characterizing feature is that cards can be installed in the case without disassembling the case.

Further benefits, features and embodiments of the invention will be apparent from the ensuing description and accompanying drawings which describe the invention in detail. A preferred embodiment is disclosed in accordance with the best mode which is contemplated for practicing the invention and the specific features in which exclusive property rights are claimed are set forth in each of the numbered claims which are appended to the detailed description.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DETAILED DESCRIPTION OF THE PREFERRED EMBODIMENT

Figure 2:
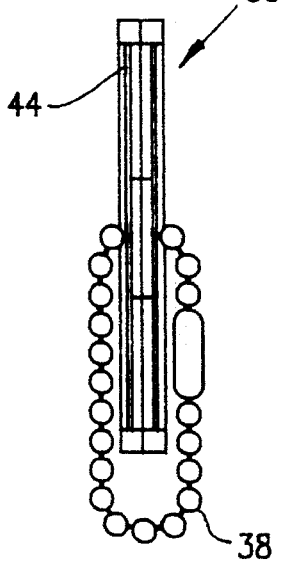
FIG. 2 is a right side view of the device shown in FIG. 1.

With reference to the drawings wherein like numerals designate like and corresponding parts throughout the several views, in FIGS. 1 through 8, inclusive, a case is illustrated for carrying a card, keys and numbered disks and for randomly picking lottery numbers. The case 30 is generally comprised of a rectangular shaped platform 31 having a first space 32 for storing numbered disks 34 and a second space 35 for storing a card 37; disks 34 bearing numbers from 1 to 50 stored in the first space 32; a transparent cover 35 attached to an upper portion of the platform 31 for covering and viewing the disks 34; an identical transparent cover 36 attached to a bottom portion of the platform 31 for covering and viewing a card 37; and a chain 38 attached to outward extending portions of each of the covers 35, 36 for carrying keys.

In the orientation depicted in the drawings, the platform 31 is comprised of a horizontal wall 39, a front wall 40, a left side wall 41, a right side wall 42, and a rear wall 43. The transparent covers 35, 36 which attach to the upper and lower portions of the platform 31 are comprised of lateral 85, front 86, right side 87, left side 88, and rear 89 walls.

The platform's right side wall at the card storing space 35 is removed and the cover's right side walls 87 are recessed to form a slot 44 in the right side of the case 30 for inserting the card 37 into the card storing space 35. The slot 44 is a characterizing feature of the invention and is a substantial improvement over the prior art. Corner portions 36 of the covers 35, 36 retain the covers 35, 36 to the platform 31.

Disassembly of the case 30 to install or change the card 37 is undesirable because it precludes a manufacturer from using low cost permanent methods such as ultrasonic welding or adhesive bonding. It is further undesirable because of possible damage to the covers 35, 36 and/or platform 31. It will be observed that when the chain 38 is attached to the covers 35, 36, the chain 38 prevents a loss of the card 37 through the slot 44.

Figure 1:
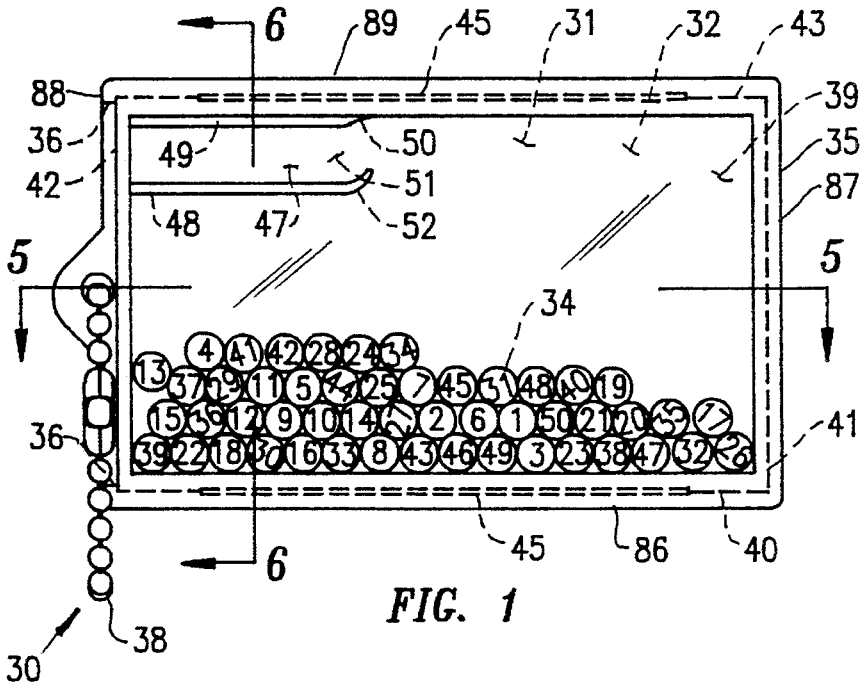
FIG. 1 is a plan view of a combined card and key carrying case and lottery number picker according to the present invention.
Figure 3:
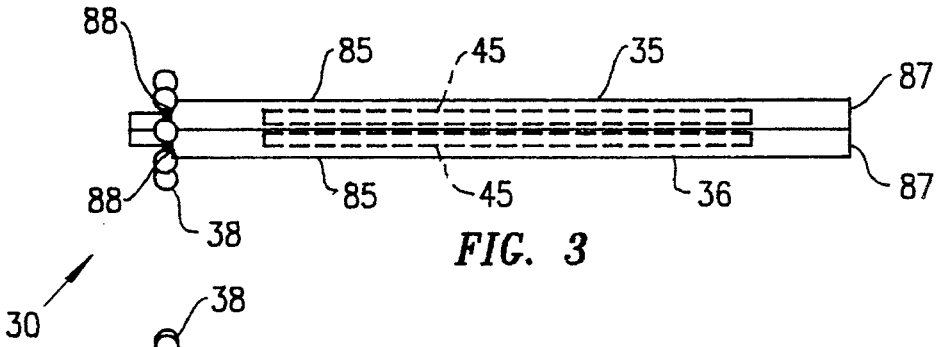
FIG. 3 is a front view of the device shown in FIG. 1.
Figure 4:
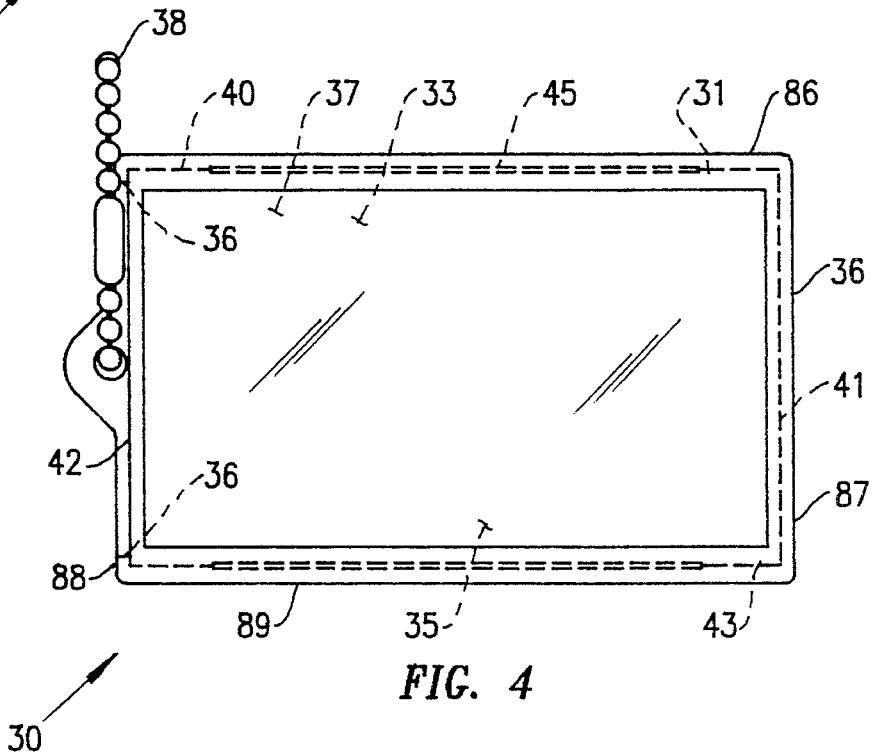
FIG. 4 is a bottom view of the device shown in FIG. 1.
Figure 5:
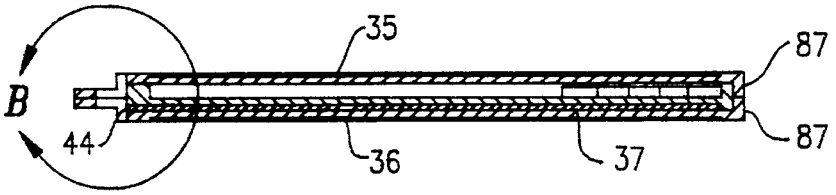
FIG. 5 is a cross-sectional view taken on the line 5—5 in FIG. 1.
Figure 7:
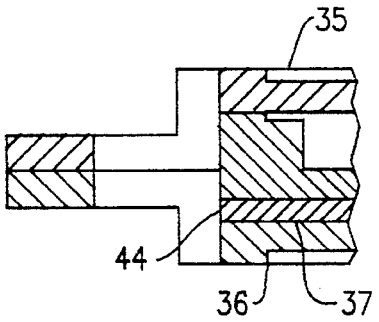
FIG. 7 is an enlarged view in circle "A" of FIG. 6.
Figure 6:
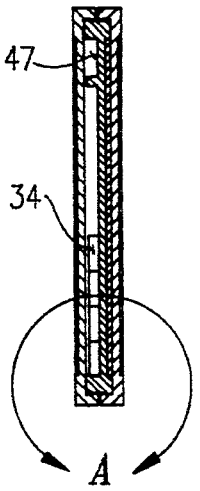
FIG. 6 is a cross-sectional view taken on the line 6—6 in FIG. 1.
Figure 8:
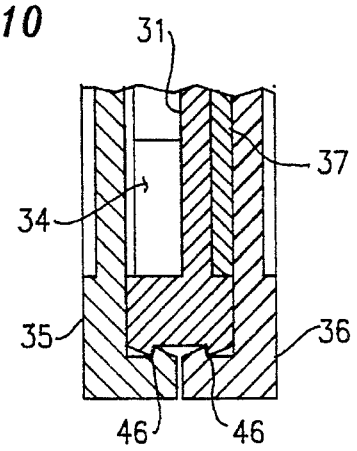
FIG. 8 is an enlarged view in circle "B" in FIG. 5.

With reference to FIGS. 1 and 8, the covers 35, 36 are attached to the platform 31 with interlocking ribs 45 which extend along the front 86, 40 and rear 89, 43 walls of the covers 35, 36 and the platform 31. The ribs 45, as shown in the enlarged cross-sectional view of FIG. 8, are sloped to facilitate interlocking. As also shown in FIG. 8, adjacent interlocking rib surfaces 46 are steeply sloped to prevent the ribs 45 from being easily disengaged. The ends of the ribs 45 are offset from the right 42, 87 and left 41, 88 side walls of the platform 31 and the covers 35, 36. The offsets are desirable to permit the covers 35, 36 and platform 31 to flex during the interlocking of the ribs 45. In the alternative, the covers 35, 36 may be joined to the platform 31 by adhesive bonding or ultrasonic welding.

Figure 22:
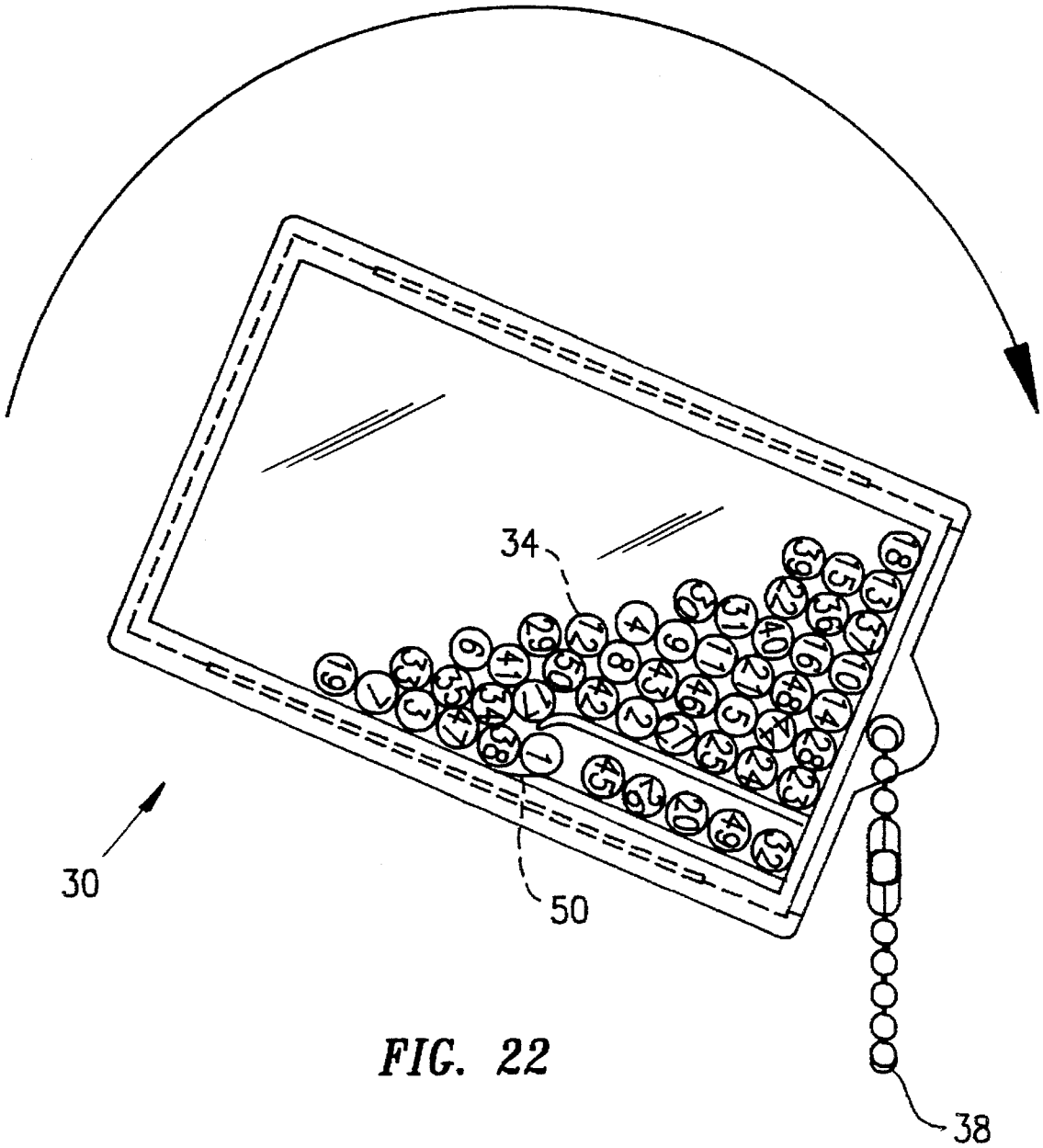
FIG. 22 is a rotated plan view showing how numbered disks are captured in a trap of the device shown in FIGS. 1–8.

Referring now to FIGS. 1 and 22, a second characterizing feature of the invention is a trap 47 in the disk storing space 32 which allows the numbered disks 34 to easily enter but impedes disks 34 from easily leaving. This feature has been found to improve the picking of lottery numbers. The length of the trap is dependent upon the number of disks 34 which must be captured. If the trap length is excessive, extra disks 34 will be captured. In the illustrated embodiment, six disks 34 are to be selected from 50 disks 34. To this purpose, the length of the trap 47 permits six disks 34, and only six disks 34, to be captured.

The trap is formed by an inner wall 48 which extends inwardly from the platform's right side wall 42, in parallel and spaced relationship to the platform's rear wall 43. The portion 49 of the rear wall 43 of the platform 31 inside of the trap 47 is joined to an adjoining portion with a ramp 50 at the entrance 51 to the trap 47. The end portion 52 of the trap's inner wall 48 is hook-shaped and curves outward toward the platform's rear wall 43.

The operation of the trap 47 can be best understood by reference to FIG. 22. During a selection of a lottery number, the case 30 is rotated to empty the trap 47 of disks 34. The case 30 is then agitated to randomize the disks 34 and rotated to capture six disks 34. When the case 30 is rotated, disks 34 accumulate at the entrance 51 of the trap 47, forcing disks 34 up the ramp 50 and into the trap 47. The movement of disks 34 on the ramp 50 pushes other disks 34 out of the path of the disks 34 which are entering the ramp 50.

When the case 30 is rotated to position trap 47 horizontal, the trap's hook-end portion 52 impedes the disks 34 from flowing out of the trap 47.

Figure 9:
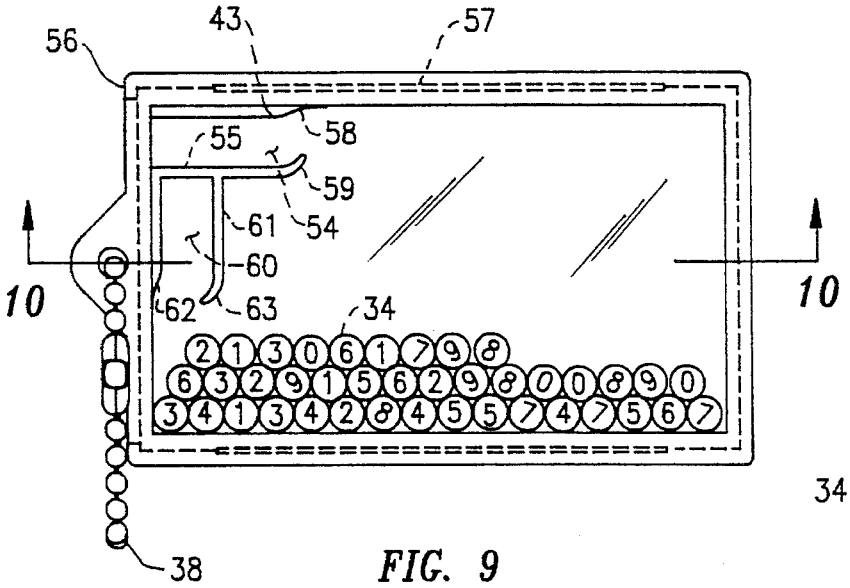
FIG. 9 is a plan view of an alternate embodiment of my combined card and key carrying case and lottery number picker.
Figure 10:
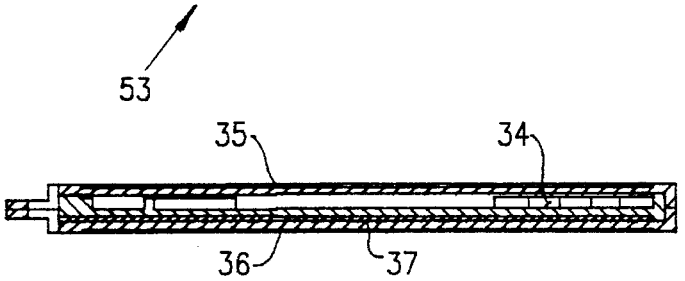
FIG. 10 is a cross-sectional view taken on the line 10—10 in FIG. 9.
Figure 11:
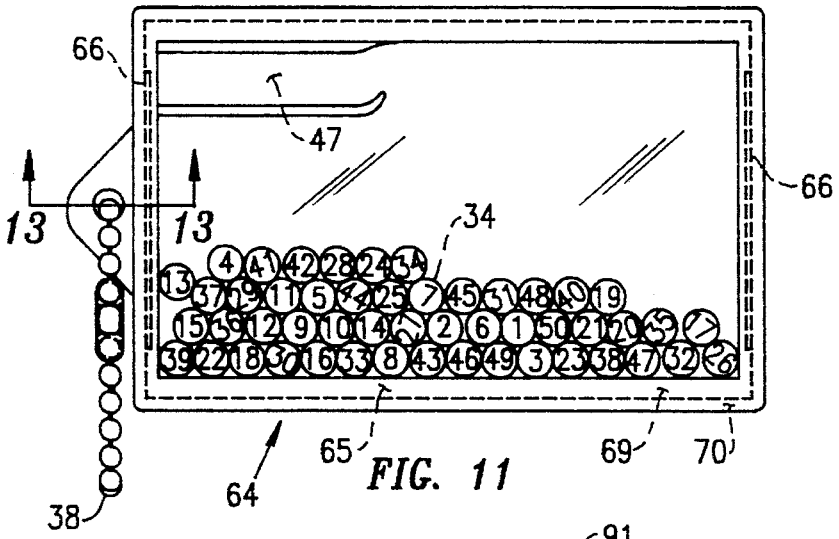
FIG. 11 is a plan view of a second alternate embodiment of my combined card and key carrying case and lottery number picker.
Figure 12:
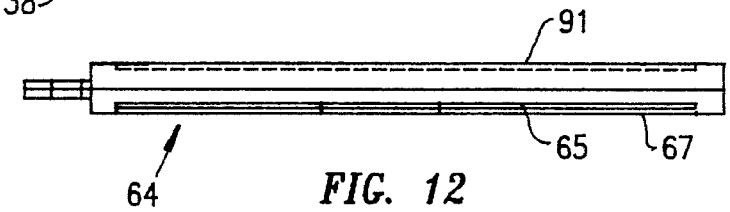
FIG. 12 is a front view of the second alternate embodiment.
Figure 13:
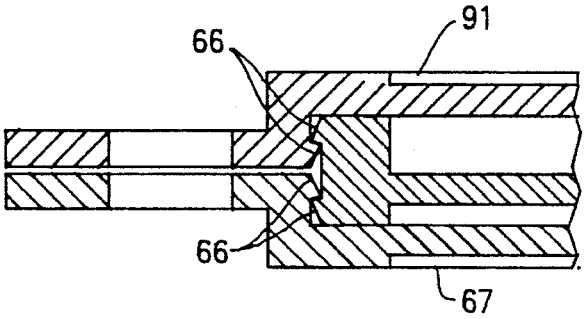
FIG. 13 is an enlarged cross-sectional view taken on the line 13—13 in FIG. 11.
Figure 14:
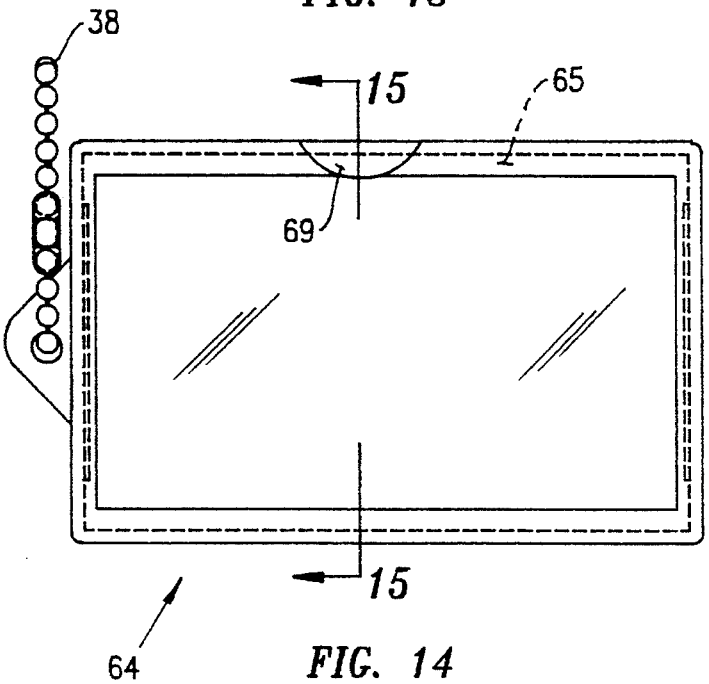
FIG. 14 is a bottom view of the second alternate embodiment.
Figure 15:
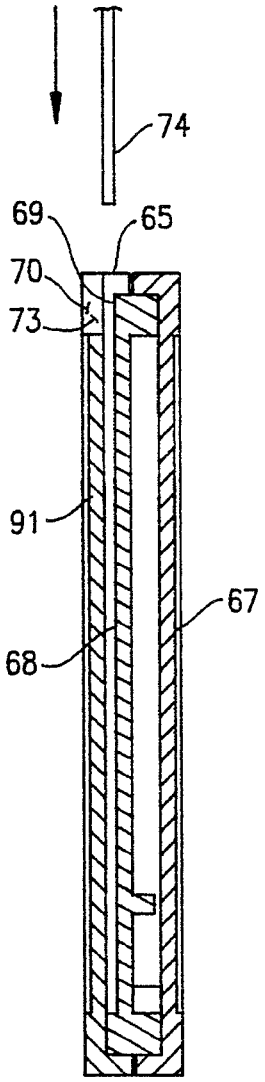
FIG. 15 is an enlarged cross-sectional view taken on the line 15—15 in FIG. 14.
Figure 17:
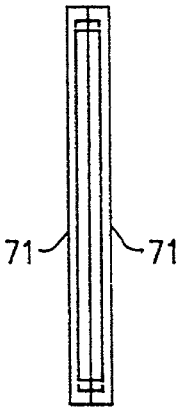
FIG. 17 is a right side view of the third alternate embodiment.
Figure 16:
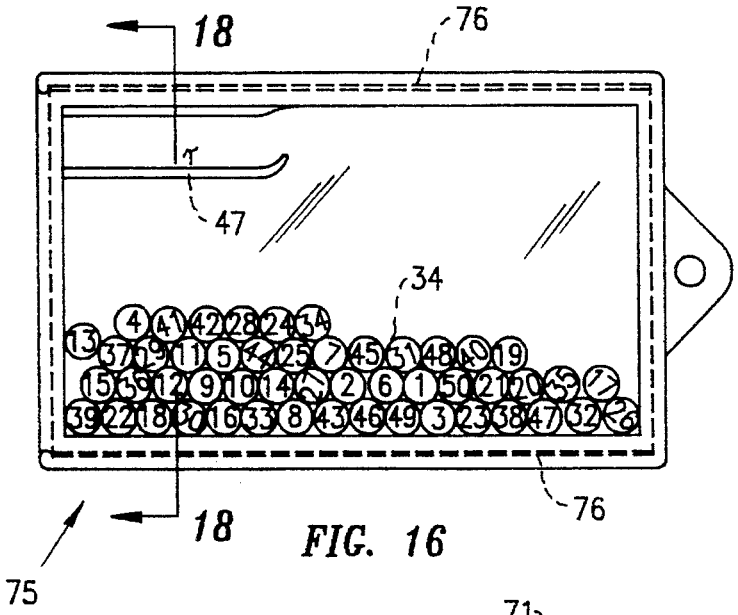
FIG. 16 is a plan view of a third alternate embodiment of my combined card and key carrying case and lottery number picker.
Figure 18:
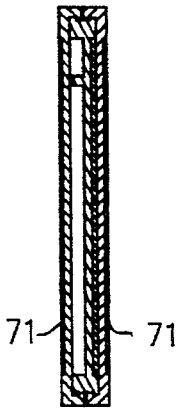
FIG. 18 is a cross-sectional view taken on the line 18—18 in FIG. 16.
Figure 19:
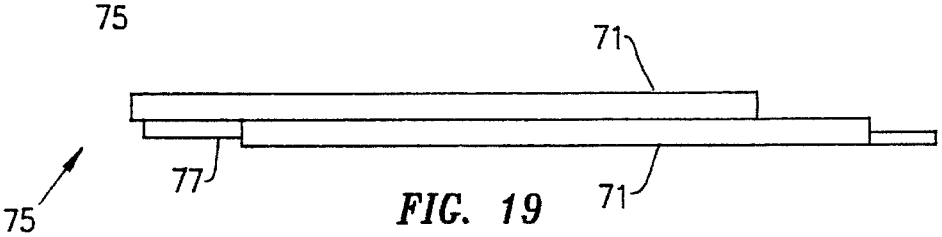
FIG. 19 is a front view of the third alternate embodiment wherein the case is open for inserting a card.
Figure 20:
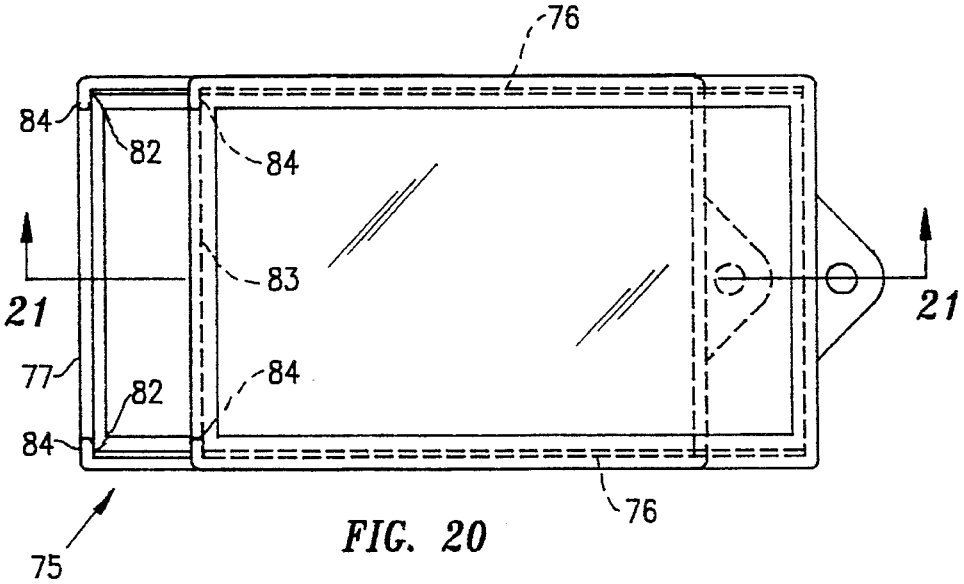
FIG. 20 is a plan view of the third alternate embodiment showing the upper cover displaced on the platform for installing a card.
Figure 21:
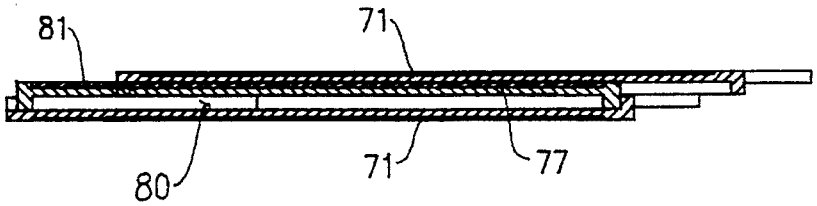
FIG. 21 is a cross-sectional view taken on the line 21—21 in FIG. 20.

Referring now to FIGS. 9 and 10, an alternate embodiment 53 is shown which is similar to the first described embodiment 30 except a pair of orthogonal traps 54, 60 are provided for picking three and four digit numbers in daily lotteries. The trap 54 for picking a four digit number is formed by extending a wall 55 inwardly from the platform's right side wall 56 in a direction which is parallel to the platform's rear wall 57. The platform's rear wall 43 inside the trap 54 is connected to an adjacent wall portion by a ramp 58 and the inner wall 55 has a hook-shaped end portion 59.

The trap 60 for picking a three digit number is formed by extending a wall 61 inwardly from the four digit number trap 54 in a direction which is parallel to the platform's right side wall 56. The right side wall 56 in the trap 60 is joined to the adjacent portion outside of the trap 60 with a ramp 62 and the inner wall 61 has a hook-shaped end portion 63.

Referring now to FIGS. 11 through 15, a case 64 is shown having a slot 65 in the front of the case 64 for inserting a card 74 into the case 64. Ribs 66 for interlocking upper 91 and lower 67 covers are provided in left and right side walls of the cover 67 and a platform 68. The slot 65 is formed by a recess in the platform's front wall 64 and a recess in the lower cover's front wall 70. A semi-circular notch 69 is provided in the lower cover 67 for inserting the card 74.

In FIGS. 16–21 a case 75 is shown having identical upper and lower covers 71 which are slideable on longitudinal ribs 76 to expose upper 80 and lower 81 spaces of a platform 77. In this embodiment, there are recesses 83 in the cover's left side walls 78 to clear the platform 77. When the covers 71 fully engage the platform 77, corner projections 84 of the covers 71 engage corners 82 of the platform 77 to retain the covers 71 to the platform 77. An advantage of this embodiment is that the numbered disks 34 can be loaded after the covers 71 are assembled to the platform 77.

From the foregoing it will be appreciated that my invention provides benefits heretofore unavailable in a lottery number picker.

Although but several embodiments have been illustrated and described, it will be understood that other embodiments can be derived by changes in shape and materials as well as numbers and substitutions of parts without departing from the spirit thereof.

I claim:

1. A compact case for cards, keys and numbered disks, said case comprised of a platform, said platform having a horizontal wall surrounded by a front wall, a pair of side walls and a rear wall, said platform's horizontal wall and said surrounding walls forming an upper space above said platform's horizontal wall for storing numbered disks and a lower space below said platform's horizontal wall for storing a thin card, said platform further having an open ended trap in said upper space for capturing an established quantity of said numbered disks stored in said upper space and a recess in a side wall of said platform for inserting a card in said lower space of said platform; a plurality of numbered disks stored in said platform's upper space; a first transparent cover attached to an upper portion of said platform for covering and viewing said numbered disks; a second transparent cover attached to a lower portion of said platform for covering and viewing a card stored in said lower space, said second transparent cover having a recess in a side wall of said cover which is aligned with said recess in said side wall of said platform, said recesses forming a slot for inserting a card into said lower space of said platform.

2. The apparatus recited in claim 1 wherein said open ended trap is comprised of a pair of parallel walls, one of said walls having a hook-shaped end portion, and the other of said walls having a ramp-shaped end portion.

3. The apparatus recited in claim 1 wherein said platform and said covers are rectangular shaped.

4. The apparatus recited in claim 1 further comprising a chain attached to outward extending side wall portions of said covers for receiving keys.

5. The apparatus recited in claim 4 wherein said slot for inserting a card extends through a side wall of said lower cover to which said chain is attached.

6. The apparatus recited in claim 4 wherein said slot for inserting a card extends through a front wall of said lower cover to which said chain is attached.

7. The apparatus recited in claim 6 further comprising a semi-circular recess in said lower transparent cover for inserting a card through said slot.

8. The apparatus recited in claim 1 further comprising a second trap in said upper space for capturing a second established quantity of disks stored in said upper space of said platform.

9. The apparatus recited in claim 8 wherein said second trap has an orthogonal relationship to said first recited trap.

10. The apparatus recited in claim 1 further comprising a card in said lower space.

11. The apparatus recited in claim 1 wherein said platform is transparent.

12. A compact case for cards, keys and numbered disks, said case comprised of a platform, said platform having an upper space for storing numbered disks and a lower space for storing a thin card, said platform further having an open ended trap in said upper space for capturing an established quantity of said numbered disks stored in said upper space; a plurality of numbered disks stored in said platform's upper space; a first transparent cover slideably attached to an upper portion of said platform for installing and viewing said numbered disks in said upper space; a second transparent cover slideably attached to a lower portion of said platform for installing and viewing a card stored in said lower space.

13. A compact case for cards, keys and numbered disks, said case comprised of a generally rectangular platform, said platform having an upper space for storing numbered disks and a lower space for storing a thin card, said platform further having an open ended trap in said upper space for capturing an established quantity of said numbered disks; a plurality of numbered disks stored in said platform's upper space; a first transparent upper cover attached to an upper portion of said platform for covering and viewing said numbered disks; a second transparent lower cover attached to a lower portion of said platform for covering and viewing a card stored in said lower space; and a means in said platform and said lower cover for inserting a card in said platform.

14. The apparatus recited in claim 13 further comprising a pair of orthogonal traps in said upper space for capturing said numbered disks stored in said upper space of said platform.

15. The apparatus recited in claim 13 wherein said upper and said lower covers are attached to said platform with pairs of interlocking longitudinal ribs.

* * * * *